United States Patent [19]

Becker et al.

[11] 4,353,940

[45] Oct. 12, 1982

[54] PROCESS FOR THE MANUFACTURE OF TUBING HAVING A COATING ON ITS INSIDE AND APPARATUS FOR CARRYING OUT THE PROCESS

[75] Inventors: Reinhold Becker, Wiesbaden; Heinz Kälberer, Walluf; Richard Regner, Mainz, all of Fed. Rep. of Germany

[73] Assignee: Hoechst Aktiengesellschaft, Frankfurt am Main, Fed. Rep. of Germany

[21] Appl. No.: 247,945

[22] Filed: Mar. 26, 1981

[30] Foreign Application Priority Data

Mar. 28, 1980 [DE] Fed. Rep. of Germany ..... 3012252

[51] Int. Cl.[3] ..... B05D 1/40; B05D 7/22

[52] U.S. Cl. ..... 427/238; 427/230; 427/394; 118/18; 118/20; 118/44; 118/56; 118/105; 118/106; 118/117; 118/DIG. 10; 118/408; 428/36; 426/135; 426/138; 138/118.1

[58] Field of Search ..... 427/177, 230, 238, 394, 427/398.1; 118/18, 20, 26, 44, 56, 67, 105, 117, 408, DIG. 10; 426/135; 138/118.1

[56] References Cited

U.S. PATENT DOCUMENTS

| | | | |
|---|---|---|---|
| 2,210,436 | 8/1940 | Weingand et al. . | |
| 2,901,358 | 8/1959 | Underwood et al. | 99/176 |
| 3,378,379 | 4/1968 | Shiner et al. | 99/176 |
| 3,378,379 | 4/1948 | Shiner et al. . | |
| 3,413,169 | 11/1968 | Krings et al. . | |
| 3,877,713 | 6/1975 | Rasmussen et al. . | |
| 4,233,341 | 11/1980 | Hammer et al. . | |
| 4,287,217 | 9/1981 | Hammer et al. | 427/230 X |

FOREIGN PATENT DOCUMENTS

| | | | |
|---|---|---|---|
| 1081033 | 7/1980 | Canada . | |
| 1545 | 5/1979 | European Pat. Off. . | |
| 733205 | 1/1945 | Fed. Rep. of Germany | 426/135 |
| 1786517 | 8/1972 | Fed. Rep. of Germany . | |
| 2557994 | 8/1978 | Fed. Rep. of Germany . | |
| 2512994 | 3/1979 | Fed. Rep. of Germany . | |
| 2512995 | 4/1979 | Fed. Rep. of Germany . | |
| 2659000 | 7/1979 | Fed. Rep. of Germany . | |
| 2801038 | 7/1979 | Fed. Rep. of Germany . | |
| 2162204 | 8/1980 | Fed. Rep. of Germany . | |
| 850504 | 12/1939 | France . | |
| 2224088 | 10/1974 | France . | |
| 984026 | 2/1965 | United Kingdom . | |
| 1060403 | 3/1967 | United Kingdom . | |
| 1201830 | 8/1970 | United Kingdom . | |
| 1444442 | 2/1976 | United Kingdom . | |
| 1461401 | 1/1977 | United Kingdom . | |

*Primary Examiner*—Shrive P. Beck

*Attorney, Agent, or Firm*—Schwartz, Jeffery, Schwaab, Mack, Blumenthal & Koch

[57] ABSTRACT

A process is disclosed for coating the inside surface of a length of tubing comprising the steps of forming at least one loop of tubing with a downwardly inclined portion and an upwardly inclined portion; filling the cavity of the tubing forming the loop with a coating liquid; transporting the tubing along its longitudinal axis in a substantially vertically upward direction to coat the inside of the tubing above the level of the coating liquid with an initial layer of coating liquid; constricting the tubing adjacent to and above the level of the coating liquid along a constriction zone transverse to the longitudinal axis of the tubing, the constriction zone progressively diminishing in width in the direction of travel of the tubing to reduce the thickness of the initial layer and form a thin layer of desired thickness on the inside of the tubing issuing from the constriction zone; filling the cavity of the tubing issuing from the metering device with support gas; and exposing the tubing to heat at a sufficient temperature to fuse the coating layer to the inside of the tubing and form an uninterrupted film of uniform thickness thereon. The coating liquid can comprise an aqueous polymeric dispersion containing at least about 15% by weight of dispersed polymer based on the total weight of the dispersion and preferrably in the range of about 15 to 60% by weight. Also disclosed is an apparatus for carrying out the process of the present invention.

26 Claims, 3 Drawing Figures

PROCESS FOR THE MANUFACTURE OF TUBING HAVING A COATING ON ITS INSIDE AND APPARATUS FOR CARRYING OUT THE PROCESS

BACKGROUND OF THE INVENTION

The present invention generally relates to a process for the manufacture of tubing made of cellulose hydrate with a coating on its inside and apparatus for carrying out the process, and more particularly to a process for the manufacture of tubular packaging sheaths made from cellulose hydrate having, on the inside, a uniformly thick, uninterrupted film coating of a natural or synthetic polymer which is virtually impermeable to water and water vapor, and to apparatus for carrying out the process.

The invention also relates to the use of the products manufactured by the processes according to the invention as a packaging sheath, in particular for pasty foodstuffs, more especially as a synthetic sausage skin for sausage intended to be boiled or cooked.

British Patent Specification No. 1,201,830 describes a process for the internal coating of tubular packaging sheaths made of cellulose hydrate, with an aqueous polymeric dispersion, in which the cellulose hydrate tubing is continuously passed horizontally through the hip of a vertical pair of nip rolls and is thereafter deflected into the vertical direction by means of a deflecting roller. The cavity of the portion of tubing issuing from the nip of the pair of nip rolls contains a certain amount of aqueous polymeric dispersion as a coating liquid. The vertically running tubing is exposed to heat above the level of the quantity of coating liquid enclosed in the cavity of the tubing.

In a process, described in U.S. Pat. No. 2,901,358, for the internal coating of cellulose hydrate tubing with an aqueous polymeric solution, the tubing to be coated, in flattened form, is first guided horizontally and is then, with partial wrap-round of the circumference of one roll of a horizontal pair of nip rolls, passed through the nip of this pair and thereafter guided vertically upwardly A certain amount of coating liquid is enclosed in the tubing cavity above the nip of the pair of rolls. The exposure to heat, in order to dry the layer on the inside of the tubing, takes place after the tubing is pressed flat in the nip of a pair of nip rolls.

German Offenlegungsschrift No. 2,801,038 discloses a process for the internal coating of tubing made of plastic or of a dense fabric which is continuously passed through the nip of a vertical pair of nip rolls. The tubing, in flattened form, is fed to the pair of rolls, in an upwardly-inclined direction, before entering the nip of the pair of nip rolls. The tubing first rests, in flattened form, partially against the circumference of the lower roll of the pair of rolls, whilst after issuing from the metering nip it rests, in flattened form, partially against the upper roll. After the flattened tubing has been lifted off the surface of the upper roll of the pair of rolls, it proceeds in an upwardly-inclined direction. The coating liquid is contained in the portion of tubing which, viewed in the direction of travel of the tubing, is upstream of the pair of nip rolls.

The known processes for the internal coating of cellulose hydrate tubing with aqueous polymeric dispersions all have the disadvantage that the cellulose hydrate tubes, which because of the high water content of the polymeric dispersions used are heavily moistened with water, tend on subsequent drying to undergo an undesirable change of dimension due to shrinkage.

They further all have the disadvantage that because of the use of aqueous polymeric dispersions having a relatively low content of dispersed polymer, the layer of aqueous polymeric dispersion on the inside of the tubing runs freely off this inside—since the low viscosity of the dispersion means that it flows easily. As a result, the polymeric film coating on the inside of the tubing, which is formed from this layer of dispersion after expulsion of the dispersing medium therefrom and fusion of the dispersed component by the action of heat, is non-uniform, and the amount of water which, in order to form the film coating on the inside of the tubing by exposing the tubing to heat, has to be expelled and transported outwardly through the tubing wall by diffusion is large in relation to the amount of the dispersed polymeric component of the dispersion.

The known processes accordingly are disadvantageous in energy terms, and furthermore lead to a non-uniform film coating on the inside of the tubing.

SUMMARY OF THE INVENTION

Accordingly, it is the object of the present invention to provide a process for forming a uniformly thick uninterrupted coating on the inside of cellulose hydrate tubing, using an aqueous liquid containing a chemical substance capable of forming a coating, as the coating liquid, which can be carried out in an advantageous manner with respect to energy consumption.

It is another object of the present invention to provide a process which permits precise metering of the coating liquid and allows internal coating in which there is virtually no run-off.

Yet another object of the present invention is to propose a process for forming a uniformly thick uninterrupted film coating of a natural or synthetic polymer on the inside of cellulose hydrate tubing, using an aqueous polymeric dispersion as the coating liquid, having a relatively high concentration of dispersed polymeric component compared to known processes, and which can be carried out in an advantageous manner with respect to energy consumption.

It is yet another object of the present invention to provide a process wherein the tubing is fed to a metering nip of a defined width under conditions which prevent creasing of the tubing, and is passed in a crease-free state into and through this nip.

It is still another object of the present invention to provide a process carried out under conditions which prevent the pressure of support gas in the tubing cavity from pressing the stock of coating liquid in a direction counter to the direction of travel of the tubing.

It is still a further object of the present invention to provide apparatus for carrying out the process of the present invention.

In order to accomplish the foregoing objects in accordance with the present invention, a process for coating the inside surface of a length of tubing essentially consisting of cellulose hydrate, comprises the steps of:

forming at least one loop of tubing with a downwardly inclined portion and an upwardly inclined portion;

filling the cavity of the tubing forming the loop with a coating liquid;

transporting the tubing along its longitudinal axis in a substantially vertically upward direction to coat the inside of the tubing above the level of the coating liquid with an initial layer of coating liquid;

constricting the tubing adjacent to and above the level of the coating liquid along a constriction zone transverse to the longitudinal axis of the tubing, the constriction zone progressively diminishing in width in the direction of travel of the tubing to reduce the thickness of the initial layer and form a thin layer of desired thickness on the inside of the tubing issuing from the constriction zone;

filling the cavity of the tubing issuing from the constriction zone with support gas; and exposing the tubing to heat at a sufficient temperature to fuse the coating layer to the inside of the tubing and form an uninterrupted film of uniform thickness thereon.

In accordance with a preferred embodiment of the present invention the coating liquid comprises an aqueous polymeric dispersion containing at least about 15% by weight of dispersed polymer based on the total weight of the dispersion; and more preferrably in the range of about 15 to 60% by weight.

In accordance with another aspect of the present invention, the constriction step comprises passing the tubing between a pair of rotatably driven endless belts positioned on either side of the tubing and having substantially straight, adjacent and mutually facing parts which progressively converge towards one another to form the constriction zone.

In accordance with yet another aspect of the present invention, the constriction step comprises passing the tubing between a pair of stationary guide elements positioned on either side of the tubing and having substantially straight, adjacent and mutually facing surfaces which progressively converge towards one another to form the constriction zone.

In accordance with a further aspect of the invention, the process further comprises the step of preventing the coating liquid present in the tubing loop from flowing in a direction counter to the direction of travel of the tubing. The step of preventing backward flow comprises flattening a part of the downwardly inclined portion of the tubing loop and can further comprise conveying the coating liquid upstream from the flattened tubing in the direction of travel of the tubing to replenish the coating liquid in the tubing loop.

In accordance with the present invention there is further provided an apparatus for coating the inside surface of a length of tubing comprising:

means for forming at least one loop of tubing with a downwardly inclined portion and an upwardly inclined portion;

means for filling the cavity of the loop with a coating liquid;

means for transporting the tubing along its longitudinal axis in a vertically upward direction;

a metering device having a constriction zone transverse to the longitudinal axis of the tubing which progressively diminishes in width in the direction of travel of the tubing; and a heater.

In accordance with the present invention the metering device comprises a pair of rotatably driven belts positioned on either side of the tubing and having substantially straight, adjacent and mutually facing parts which progressively converge towards one another. Alternatively, the metering device can comprise a pair of stationary guide elements positioned on either side of the tubing and having substantially straight, mutually facing and adjacent surfaces which progressively converge towards one another.

In accordance with the present invention, the apparatus further comprises means for preventing the coating liquid present in the tubing loop from flowing in a direction counter to the direction of travel of the tubing. Further, additional coating liquid can be conveyed to replenish the coating liquid in the loop during the prevention of backward flow.

Further objects, features and advantages of the invention will be apparent as the following description proceeds, and with particular reference to the application drawing.

DETAILED DESCRIPTION OF THE PREFERRED EMBODIMENTS

Figure 1:
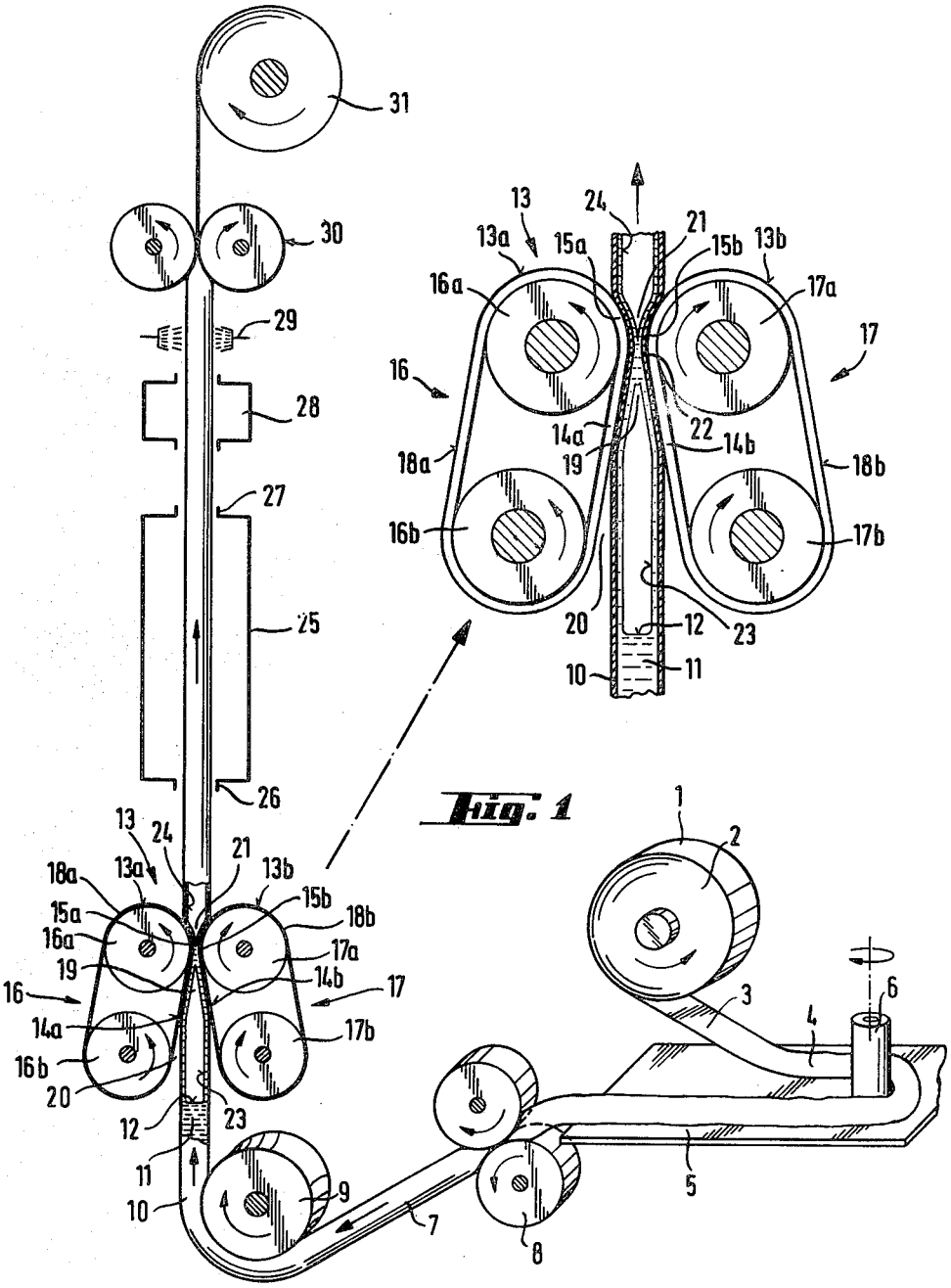
FIG. 1 schematically illustrates an apparatus for the implementation of the process according to the present invention.

In the text which follows, a horizontal pair of rolls is to be understood as a pair of rolls having axes of rotation substantially transverse to the direction of travel of a substantially vertical portion of the tubing and arranged so that a common substantially horizontal plane can be passed through the parallel axes of the rolls. A horizontal nip is understood to be a nip which is defined by the mutual facing outer surfaces of the parallel, spaced rolls of a pair of rolls arranged as described above. Further, the nip is formed transverse to the longitudinal axis of the tubing.

In carrying out the process, the tubing is transported continuously and at a substantially constant speed in the direction of its longitudinal axis. In the text which follows, the said movement of the tubing will, for brevity, be referred to as "transportation".

The transportation of the tubing can, for example, be effected by passing the tubing, after drying and cooling but before winding-up, continuously through the nip of a pair of rotatable squeeze rolls, which are of drivable construction and are, for example, driven by means of motors.

The process is carried out by transporting the tubing at a speed which is advantageously in the range of about 8 to 60 m/min. A speed of transportation of the tubing in the range of about 20 and 40 m/min is particularly advantageous.

An aqueous polymeric dispersion which contains a high proportion of dispersed polymer relative to the amount of dispersion medium is used to carry out the process. An aqueous polymeric dispersion with a high proportion of dispersed polymer, relative to the total weight of the aqueous dispersion, is considered to be a dispersion which contains at least about 15% by weight of dispersed polymer. Aqueous polymeric dispersions which contain an amount in the range from about 15 to 60% by weight, preferably from about 20 to 60% by weight and especially preferably from about 30 to 40% by weight, of dispersed polymer, in each case relative to the total weight of the dispersion, are regarded as particularly advantageous.

Aqueous polymeric dispersions suitable for carrying out the process are especially those wherein the dispersed polymer is able, after expulsion of the dispersing medium and fusion of the dispersed component by sufficient heat, to form films, in particular films which are virtually impermeable to water and water vapor. Preferred aqueous polymeric dispersions are those which contain, as the dispersed polymeric component, copolymers containing a preponderant proportion of copolymerized vinylidene chloride, advantageously those which contain at least about 75% by weight of copolymerized vinylidene chloride. Very particularly suitable aqueous polymeric dispersions are those, having the stated concentration, which contain, as the dispersed polymeric component, copolymers which are described in German Auslegeschrift No. 2,512,995 and German Pat. No. 2,512,994. The said polymers and polymeric dispersion are not, per se, a subject of the present invention.

The cellulose hydrate tubing which is used to carry out the invention and is preferably fiber-reinforced and advantageously has a swelling value in the range of about 120 to 140%. The cellulose hydrate tubing, for example, has a wall thickness in the range of about 30 to 300 μm, advantageously in the range of about 80 to 120 μm.

Fiber-reinforced cellulose hydrate tubing is to be understood as tubing which contains a fiber web embedded in its wall. The fiber insert in the tubing wall does not hamper the diffusion of water through the wall.

The preferred fiber-reinforced cellulose hydrate tubing advantageously has, in its wall, a water content in the range from about 8 to 12% by weight, relative to the total weight of the tubing, and a content of about 18 to 24% by weight, advantageously of about 22% by weight, of a chemical agent capable of plasticizing cellulose hydrate, for example glycerol, glycol or polyglycol. The percentage by weight data in each case relate to the total weight of the fiber-reinforced cellulose hydrate tubing.

The cellulose hydrate tubing described above, which preferably is fiber-reinforced and contains a chemical plasticizer and water, is not, per se, a subject of the present invention.

Within the scope of the present description of the invention and of the claims, the definition of the term "cellulose hydrate tubing" is such as to include both tubing, comprising cellulose hydrate in the gel state, which has not yet been subjected to a drying process and which contains the abovementioned proportion of chemical agent, capable of plasticizing cellulose hydrate, of the stated chemical composition and in the stated amount, as well as cellulose hydrate tubing which has already been subjected to a drying process and contains the stated porportion of water and plasticizer of the stated type and carries, on its surface, an adhesion-promoting layer of a chemical agent which is permeable to water and water vapor, for example, a layer of a water-insoluble reaction product, formed by heat-curing of epichlorohydrin and a polyamine-polyamide. For example, the layer has a thickness corresponding to a weight per unit area in the range of, advantageously, about 30 to 100 mg/m$^2$ of substrate surface. The said adhesion-promoting layer has the effect, when carrying out the process, that in the product obtained the plastic film coating is firmly bonded to the substrate surface.

The stated tubing of cellulose hydrate in the gel state, and the stated tubing of cellulose hydrate possessing an adhesion-promoting layer of a chemical substance on its surface, are each referred to, in the description of the invention as the "initial tubing". This tubing in each case represents the starting material for the process. Preferably, the initial tubing is in each case fiber-reinforced.

For example, there is described and used as the initial tubing or process starting material an advantageously fiber-reinforced cellulose hydrate tubing which has a swelling value of about 120 to 140%, for example of about 130%, a water content of about 8 to 12% by weight, for example, of about 10% by weight, and a glycerol plasticizer content of about 18 to 24% by weight, for example of about 22% by weight. Further, the tubing possesses, on its inside, a water-permeable and water vapor-permeable, thin adhesion-promoting layer of a chemical substance, for example a layer, of a thickness corresponding to about 30–100 mg/m$^2$, of a water-insoluble reaction product of epichlorohydrin and a polyamine-polyamide.

The process is carried out in such a way that the polymeric film coating on the inside of the end product of the process (the process product) has a thickness corresponding to a weight per unit area in the range of, advantageously, about 8 to 20 g of polymer per m$^2$ of substrate surface, preferably about 10 to 15 g of polymer per m$^2$ of substrate surface. The film coating is physically homogeneous, uniformly thick and uninterrupted.

The manner of carrying out the process according to the invention will be described below by way of example. To carry out the process, a particularly suitable apparatus is used, and this will also be described.

The initial tubing, for example, has a diameter of about 90 mm, with a flattened width of about 143 mm.

A long piece of said tubing, for example, a length of about 350 m, is wound in flattened form on a rotatably constructed stock drum mounted in a fixed position.

The tubing is continuously unrolled from the stock reel and is transported in its longitudinal axial direction, so as to form a loop of tubing, first in a downward direction and thereafter, following a change of direction, for example by means of a rotatably constructed guide roller, in an upward direction, at a constant speed, for example of about 20 to 40 m/min. In the cavity of the piece of tubing which forms the tubing loop there is a certain amount of an aqueous dispersion of a polymer, for example, about 10 liters of a dispersion, for example, of about 30 percent strength by weight, in which the dispersed polymeric component for example, comprises about 88% by weight of copolymerized vinylidene chloride, about 3% by weight of copolymerized acrylic acid, about 4% by weight of copolymerized acrylonitrile and about 5% by weight of copolymerized methyl acrylate. The percentages by weight in each case relate to the total weight of the dispersed copolymer. A dispersion of the said concentration can be prepared, for example, by starting from a dispersion of a relatively high concentration, for example, about 55% by weight of dispersed copolymer, and bringing it, by dilution with water, to the concentration appropriate for carrying out the process.

The stated amount of stock of aqueous polymeric dispersion which is required to coat the inside of the total length of cellulose hydrate tubing with a polymeric film coating and which, at the start of the process, is introduced into the cavity of the tubing, is such that the cavity of the vertical part of the tubing loop is partially filled with coating liquid. Sufficiently far bove the level of the proportion of the coating liquid stock contained in the vertical part of the tubing loop, the tubing is passed continuously, under conditions which prevent creasing thereof, towards the metering nip of a metering device possessing a metering nip substantially transverse to the direction of transportation of the tubing and is passed in a crease-free state through this nip.

The term "tubing with support gas in the tubing cavity" relates to the tubing which issues from the metering nip of the metering device and runs substantially vertically upwardly, and has a thin liquid layer of aqueous polymeric dispersion on its inside. Air is the preferred support gas.

The wording "tubing with support gas in its cavity and a thin liquid layer of aqueous polymeric dispersion of a given concentration on its inside" is defined to embrace portions of the tubing whch are circular or virtually circular in cross-section.

The shape of the tubing with support gas in the cavity is ensured by a pressure of support gas adequate for maintaining its cross-sectional shape. In the case of tubing of circular cross-section filled with support gas, the support gas can also exert a pressure on the inner wall of the tubing, which, to a slight degree, can cause radial stretching of the tubing.

To prevent the support gas in the tubing cavity from perhaps forcing, by virtue of its pressure, the stock of coating liquid in the tubing loop counter to the direction of travel of the tubing and towards the stock reel, it is advantageous if the tubing, filled with stock liquid, is continuously pressed flat in the direction of travel of the tubing, before the tubing is deflected in a vertical direction by the guide roller. For example, this is achieved by passing the tubing continuously through the nip of a pair of squeeze rolls with rotatably designed rolls, in the nip of which pair of squeeze rolls the liquid-filled tubing is pressed together. The continuous pressing-together of the tubing which is running in a downwardly-inclined direction, can advantageously also be effected by, simultaneously with this pressing-together, constantly replenishing the coating liquid, at the rate at which it is consumed by internal coating of the tubing, so as to maintain the level of the liquid in the vertical portion of tubing. This combined effect can, for example, advantageously be achieved by passing the tubing through the nip of a cooperating pair of conveyor belts which are profiled on their outer faces, as described in German Patent No. 2,659,000 or No. 2,557,994 both of which are herein incorporated by reference.

A thin, liquid layer of aqueous polymeric dispersion on the inside of the tubing filled with support gas is to be understood as a layer which is thinner than the layer which is present on the inside of the vertically guided tubing before the latter enters the metering nip of the metering device, and which, after expulsion of the dispersing medium from the liquid layer and fusion of the dispersed component by the action of heat at an adequately high temperature, gives an uninterrupted, uniformly thick film coating having a thickness corresponding to a weight per unit area of, advantageously, about 8 to 20 g of polymer per $m^2$ of substrate surface. The relative balance of the said process parameters can be determined, for each individual case, in a simple manner by a small number of simple preliminary experiments.

The continuous transportation of the tubing through the metering nip of the metering device has the effect that aqueous dispersion builds up in the tubing cavity, immediately before the metering nip, in an amount depending on the speed of transportation of the tubing and on the concentration of the aqueous polymeric dispersion used.

The tubing which leaves the metering nip of the metering device is filled with support gas and bears a thin layer of aqueous polymeric dispersion. As the tubing is led substantially vertically upwardly and exposed to the action of heat at a sufficiently high temperature to expel the dispersing medium of the thin, liquid layer on the inside of the tubing by outward diffusion through the tubing wall, an uninterrupted polyermic film coating is formed on the inside of the tubing.

The exposure of the tubing to heat, so as to dry the liquid layer of aqueous dispersion on the inside of the tubing filled with support gas, is effected, for example, by passing the tubing vertically upwardly through a straight drying tunnel, for example, a tunnel equipped with infrared heating elements. At the start of the drying tunnel the tubing is, for example, heated to a temperature of about 80° C., while at the end of the tunnel it is heated to a temperature of, for example, about 140° C.

Before exposure to heat, the tubing is advantageously passed through a gas zone, for example, having a length in the range of about 50 to 100 cm. The surrounding gas in the zone is preferably air at about room temperature.

After exposing the tubing to heat and forming a film coating on its inside, and then cooling the latter to the point that the film coating is no longer tacky, for example, by exposing the tubing continuously to a cold gas, for instance, by means of a cold air bath, the tubing is, optionally, moistened with water, for example, by spraying by means of a spray jet, and is thereby advantageously brought to a water content in the range of about 8 to 12% by weight, for example, about 10% by weight, in each case relative to the total weight of the tubing.

The amount of support gas required in the cavity of the piece of tubing which has issued from the metering nip of the metering device is introduced into this cavity at the start of carrying out the process. The internal pressure in the tubing is maintained, while carrying out the process, by continuously pressing the tubing flat (after it has left the drying tunnel after the polymer film coating has been formed by drying the thin layer, and the tubing has been cooled and, if appropriate, moistened with water) along a narrow zone over its entire width, for example, by passing it through the nip of a pair of squeeze rolls.

The circumferential speed of the squeeze rolls driven, for example, by motors, of the pair of nip rolls is advantageously in the range of between about 8 and 60 m/min; for example, the rolls have a circumferential speed of about 30 m/min.

As a result of the frictional contact of the circumferential surfaces of the pair of squeeze rolls with the outer faces of the tubing, the circumferential speed of the rolls determines the speed of transportation of the tubing.

The process product is then wound up on a reel which is designed to be rotatable and drivable, and which is driven.

The term "metering device having a horizontal metering nip" comprises, according to the invention: a pair of endless belts having a substantially vertical lengthwise axis of symmetry; a pair of stationary, flat, planar guide or shaping elements spaced apart from one another but converging, resembling in their shape a doctor blade or scraper; or a substantially horizontal pair of rotatable rolls.

In its first embodiment, the metering device having a horizontal metering nip comprises a pair of endless belts which conjointly delimit a metering nip substantially transverse to the direction of transporation of the tubing in which mutually facing adjacent outer surfaces of straight belt-zones of the endless belts conjointly define a nip space. The width of the metering nip is defined by the particular spacing of the mutually facing outer surfaces of the belts, and varies progressively from one end of the nip space to the other. The region of minimum width of the nip space, delimited by the belts, is referred to as the metering nip of the pair of endless belts. The broadest region of the nip space is referred to as the nip space entry and the narrowest region as the nip space exit (metering nip).

The endless belts, of a conveyor-belt type, which conjointly form the pair of endless belts are arranged symmetrically to one another and symmetrically to a conjoint substantially vertical straight axis of symmetry of the pair of endless belts, in such a way that their straight, adjacent and mutually facing parts progressively converge towards one another and each progressively converges to the axis of symmetry. As a result the distance between the mutually opposite adjacent outer faces of the belts progressively varies in the sense that it is greater, in the region of the entry of the nip space they delimit, than the diameter of the tubing, while in the region of the nip space exit it corresponds to the requisite width of the metering nip of the device. The nip space entry is at the lower end, and the nip space exit at the upper end, of the device comprising the pair of belts. The device is fixed in the space in such a manner that its lengthwise axis of symmetry runs substantially vertically.

The metering nip of the device is adjustably set to a certain width.

The nip space is wider at its entry than the diameter of the tubing. The predetermined width of the adjustably set metering nip is chosen so that the tubing which passes through it is partially flattened thereby, in such a way that the tubing wall encloses a narrow cavity of such shape that the tubing leaving the metering nip possesses, on its inner face, a thin, liquid layer of aqueous polymeric dispersion. The thickness of the layer is such that after expelling the dispersion medium and fusing the dispersed component by exposure to heat at an adequate temperature, a polymeric film coating is produced on the inside of the tubing and this coating has a thickness corresponding to a weight per unit area in the range of, advantageously, about 8 to 20 g of polymer per $m^2$ of substrate surface.

In carrying out the process using the metering device in the form of the pair of endless belts with a metering nip, just described, the tubing which is transported substantially vertically upwardly enters, above the level of the portion of coating liquid contained in the vertical length of tubing, the nip space of the pair of endless belts. At the nip space entry, the tubing passes vertically upwardly through the nip space in such a way that the longitudinal axis of the tubing virtually corresponds to the longitudinal axis of symmetry of the pair of endless belts. On passing through the nip space on its way to the metering nip, the tubing is continuously progressively flattened by continuous contact of its faces with the outer surfaces of the endless belts, and passed into, and through, the metering nip in a crease-free state. Feeding the tubing to the metering nip of the metering device according to the invention under conditions which prevent creasing of the tubing, achieved by progressively increasing the flattening of the tubing before the latter enters the metering nip, is particularly advantageous when using tubing of large width, for example, of about 120 mm in diameter. The continuous belts of the pair of endless belts are preferably of equal length, with each comprising a belt which is continuous and whose width at least corresponds to the width of the layflat tubing.

Each endless belt of the pair of belts possesses integrally two straight parts, preferably running parallel to one another, whose inner surfaces face one another, and each possesses two opposite, semi-circularly curved belt regions. The lateral faces of the endless belts are in pairwise alignment. The outer faces of the endless belts are smooth, i.e., not profiled construction.

The endless belts are flexible and comprise material which gives the belts sufficient dimensional stability, such as a plastic, rubber, thin metal or the like.

The endless belts each possess a pair of guide rollers, preferably of identical size, which cooperate with the endless belt. The rigid-shaped guide rollers advantageously comprise a metal or a plastic material, for example of a polyamide.

The inner faces of the curved parts of the endless belts are each partially in contact with the circumference of the guide rollers, with frictional force transmission in the contact region. The guide rollers of each belt are each centrically fixed on axles which are each rotatably mounted. One of the axles of each pair of belts is constructed to be drivable, for example, by the end of the axle being coupled to a motor.

The axles of the guide rollers of each endless belt of the pair of belts all run substantially transverse to the direction of transportation of the tubing and are parallel to one another. The endless belts of the pair of belts are so arranged relative to one another that in each case the upper roller of the pair of guide rollers of one belt of the pair of endless belts forms a roller pair with the upper roller of the pair of guide rollers of the other endless belt, a common substantially horizontal plane passing through the axes of the guide rollers forming the roller pair.

The term "upper" guide roller of a pair of guide rollers of an endless belt relates to the upper end of the substantially vertical longitudinal axis of symmetry of the pair of endless belts.

Preferably, the inner faces of the endless belts, and the circumferential faces of the guide rollers, have an oppositely matching surface structure, which is of such construction that it intensifies the frictional force-transmission contact between the two surfaces.

The endless belts of the pair of belts are each driven at the same circumferential speed and in opposite circumferential directions.

In an alternative embodiment, the metering device having a metering nip comprises a pair of guide elements or shaping elements, resembling in its shape a doctor blade or a scraper.

The elements which form the pair are of two-dimensional construction and flat; the surfaces of the elements are smooth, that is to say not profiled; the elements are of stable shape and comprise, for example, a plastic or metal.

The guide elements or shaping elements which form the pair are preferably of rectangular shape and are preferably of equal dimensions. The elements of the said construction, forming the pair, are of identical shape and dimensions. The element pair has a substantially vertical lengthwise axis of symmetry.

The plate-shaped elements which form the pair of guide elements or shaping elements are fixed and arranged in space relative to one another in such a way that they converge and that the mutually facing surfaces of the elements conjointly delimit a nip space whose width varies progressively from one end to the other. In the region of its minimum width, the nip space is referred to as the metering nip of the pair of elements.

By definition, the nip space entry is the widest region, and the nip space exit the narrowest region of the nip space.

The pair of guide elements or shaping elements is so arranged in space that the narrowest region of its nip space (metering nip) is at the upper end, and the widest region at the lower end, of the device; the terms "lower" and "upper" in each case relate to the vertical longitudinal axis of symmetry of the device.

The width of the nip space of the pair of elements at the entry of the space is greater than the diameter of the tubing.

The horizontal metering nip of the pair of elements has a fixed width so that the tubing, when being passed through the metering nip, is partially flattened in such a way that the tubing wall encloses a narrow cavity, which is of such dimensions that the tubing issuing from the metering nip possesses, on its inner face, an aqueous, thin layer of a thickness such that after expelling the dispersing medium from it outwardly through the tubing wall, and fusing the dispersed component by the action of heat at a sufficient temperature, a polymeric film coating is produced on the inside of the tubing. The thickness of the coating corresponds to a weight per unit area in the range of, advantageously, about 8 to 20 g of polymer per $m^2$ of substrate surface.

In yet another embodiment of the present invention a pair of metering rolls are used to form the metering nip; the diameter of the rolls will be relatively large in order to prevent the creasing of the tubing during transition from the inflated to the partially flattened state upon entry into the metering nip. Preferably, in front of the pair of metering rolls, devices are used that are customary in the creaseless flattening of extruded plastic tubing. For example, guide panels or plates, roller conveyors, conveyors or guide rolls can be employed that form a conically shaped space diminishing in size as the tubing approaches the metering nip. These devices gradually flatten the tubing from an inflated state.

In order to substantially keep constant the distance between the level of the amount of coating liquid, enclosed in the cavity of the vertically upwardly transported tubing, to the metering nip of the metering device over the entire period of the coating operation, it is advantageous, in carrying out either of the process variants, to guide the length of tubing filled with a certain stock amount of coating liquid in such a way that this length of tubing, before forming the straight, vertically upwardly-travelling part of the tubing, is first guided to form at least one loop filled with coating liquid, in which loop the longitudinal axis of the tubing is located in a substantially horizontal plane which runs a short distance below the plane in which the metering nip of the apparatus extends. The substantially horizontal, planar support surface for the substantially horizontal tubing loop is referred to as the support plate.

The support plate for the substantially horizontal tubing loop can be, for example, a plate fixed to a frame.

In order to be able to guide the tubing, which is constantly transported in the direction of its longitudinal axis, so that it forms a substantially horizontal tubing loop on the support plate, at least one rotatably constructed deflecting roller is provided on the upper face of the support plate, the axis of the roller forming a substantial right angle with the plane of the plate. The axis of the deflecting roller is fixed, by one of its ends, to the support plate.

To form a substantially horizontal tubing loop, the tubing filled with coating liquid is guided so that its outer face partially adjoins the circumference of the guide roll and so that the latter changes the direction of the tubing, forming a loop. To resupply the coating liquid, a pair of rolls or conveyors are used, such as those described in German Pat. No. 2,659,000 or No. 2,557,994, to partially flatten a portion of the tubing loop. This arrangement further provides the advantage of preventing the flow of coating liquid counter to the transportation of the tubing.

The dried tubing is then cooled, for example, by exposing it continuously to cold air, for instance by means of a cold air bath.

The pieces of apparatus appropriate for carrying out the process according to the invention each also comprise the requisite devices for holding the individual elements of the apparatus in a fixed position.

It is characteristic of the process carried out according to the invention that over the period of time in which the cellulose hydrate tubing is in contact with aqueous polymer dispersion of the stated concentration, the amount of water taken up from the dispersion by the tubing or the amount of water which diffuses from the liquid layer into the tubing is only such that the water content in the cellulose hydrate tubing is always less than that which corresponds to the swelling value (water-retaining capacity) of the cellulose hydrate tubing.

The water content of the tubing when carrying out the process amounts preferrably to about 20 to 30% and in particular only about one-quarter of the amount of water which corresponds to the swelling value of the initial tubing (the swelling value is determined in accordance with DIN 53,814; "Farberei- und textilchemische Untersuchungen" ("Investigations in Dyeing and Textile Chemistry"), A. Agster, page 450, Springer Verlag 1967, 10th edition).

The advantages of the invention, resulting from what has been described above, over the prior art are shown by the following comparisons:

To produce a film coating, for example, of a thickness corresponding to a weight per unit area of about 10 g of polymer per $m^2$ of substrate surface it is necessary, in the known process, when using an aqueous polymeric dispersion of the customary concentration of, for example, about 6.5% by weight of dispersed polymer, to expel 143.8 g of water per $m^2$ of substrate surface by the action of heat on the tubing, in order to form the film coating referred to.

On the other hand, to form a polymeric coating of a thickness corresponding to about 10 g of polymer per $m^2$ of substrate surface on the inside of the tubing it is only necessary, when carrying out the procedure according to the invention and using, for example, a 30 percent strength by weight polymer dispersion, to expel 23.3 g of water per $m^2$ of substrate surface by the action of heat on the tubing in order to form the film coating.

The process according to the invention, in both its variants, accordingly only requires, for the production of a polymeric film coating of a thickness corresponding to 10 g of polymer per $m^2$ of substrate surface, about one-sixth of the amount of thermal energy which is necessary to form a film coating of the same thickness when carrying out the known coating processes.

Furthermore, because of the small amount of water to be expelled from the liquid layer of aqueous polymeric dispersion in order to form a polymer film on the inside of the tubing, the process according to the invention permits a substantial increase in the coating speed.

In the process according to the invention, coating defects resulting from the aqueous polymeric dispersion having a high content of dispersed polymer, which is used in carrying out the process, are avoided for the following reasons. Using, as the starting material, cellulose hydrate tubing having a swelling value (water retention capacity) of, for example, about 120%, it is necessary, in the known processes, when using, for example, a 6.5 percent strength by weight aqueous polymeric dispersion, and carrying out the process so as to form a film coating corresponding to a thickness of, for example, 10 g of polymer per $m^2$ of substrate surface, that the tubing should take up 143.8 g of water per $m^2$ of tubing and that this amount should be transported by diffusion through the tubing wall.

In contrast, when carrying out the process according to the invention and using a polymeric dispersion which, for example, contains 30% by weight of dispersed polymer component, the initial tubing, having the stated swelling value of about 120% is only moistened slightly.

Since, in order to form the uninterrupted polymeric film coating on the inside of the tubing by expelling the dispersing medium from the liquid layer of aqueous polymeric dispersion on the inside of the tubing, the entire amount of water in the liquid layer must be transported away by outward diffusion through the tubing wall, and the rate of diffusion and the water content of the liquid layer of aqueous dispersion essentially determines the speed with which the coating process can be carried out.

The advantages of the process according to the invention, in all its embodiments, are briefly summarized below:

1. Use of an aqueous polymeric dispersion having a high content of dispersed polymer; energy-saving process operation; possibility of carrying out the process at a speed which is twice to four times as great as the coating speed in known processes.
2. No free run-off of the aqueous dispersion.
3. Controlled metering and evening-out of the dispersion applied; defects due to run-off are avoided.
4. Accumulation of plasticizer in the dispersion reserve has only an insignificant effect on the quality of the film coating, because of the high content of dispersed component.
5. Because of the use of an aqueous polymeric dispersion having the stated content of dispersed polymer and of dispersing medium, and because of precise metering in the metering nip of the device, the desired coating thickness is virtually independent of the diffusion properties of the initial tubing.
6. Starting from a given amount of initial tubing to be coated on its inside with a film coating of a given thickness, the process is substantially easier to carry out than the known coating processes, because of the lower total amount of aqueous dispersion required for internal coating of the piece of tubing; with this lower total requirement, when coating very long pieces of tubing by the process according to the invention, the coating liquid requires replenishment at substantially longer intervals of time than in the case of known processes, and the waste tubing produced by the tubing incision which has to be made for such replenishment is substantially reduced.
7. An apparatus is also proposed for the simultaneous replenishment of the coating liquid and prevention of backflow of the coating liquid counter to the transportation of the tubing.

The process and three apparatuses particularly suitable for carrying out the process are described hereinafter with reference to FIGS. 1, 2, and 3 in the form of examples.

In FIG. 1, 1 denotes a stock reel with tubing 2 rolled up thereon. A piece of tubing 3 is drawn off the stock reel and transported in the direction of the longitudinal axis of the tubing to form a horizontal tubing loop 4 which rests on a support 5 having a rotatable deflecting roller 6 attached to the upper face thereof. A piece of tubing 7 extends in a downwardly inclined manner in the direction of travel of the tubing and is flattened by a pair of rolls 8 for the resupply of coating liquid 11 and to prevent the backflow of coating liquid 11 into the tubing loop 4. A deflecting roller 9 guides a piece of tubing 10 vertically upwardly so that the coating liquid 11 has a level 12 in the cavity of the vertical piece of tubing 10. A cooperating pair of endless belts 13 comprise a first continuous conveyor-like endless belt **13*a* and a second continuous conveyor-like endless-belt 13*b*, wherein 14*a* is a straight portion of the first endless belt, 14*b* a straight portion of the second endless belt, 15*a* is a curved portion of the first endless belt and 15*b* is a curved portion of the second endless belt. The endless belts 13*a* and 13*b* are provided with guide rollers 16*a*, 16*b* and 17*a*, 17*b*, respectively. Outer faces 18*a*, 18*b* of the endless belts 13*a*, 13*b* delimit a nip space 19 which progressively narrows such that the entrance 20 of the nip space is wider than the exit of the nip space, referred to as the metering nip 21. A piece of tubing 22 before entering the metering nip 21 bears a liquid layer 23 of aqueous polymer dispersion on the inside thereof. A thin, liquid layer 24 of aqueous polymer dispersion is formed on the inside of the tubing after issuing from the metering nip which is exposed to heat in a drying tunnel 25, for example, being heated by hot air and having an entry 26 and an exit 27. A cold air bath 28 cools the tubing passing therethrough before exposing the dried tubing to water in a spray device 29. A pair of squeeze rolls 30 are also provided through which the tubing is transported before storage on a rotatably constructed stock reel 31** which is driven by means of a motor or the like.

Figure 2:
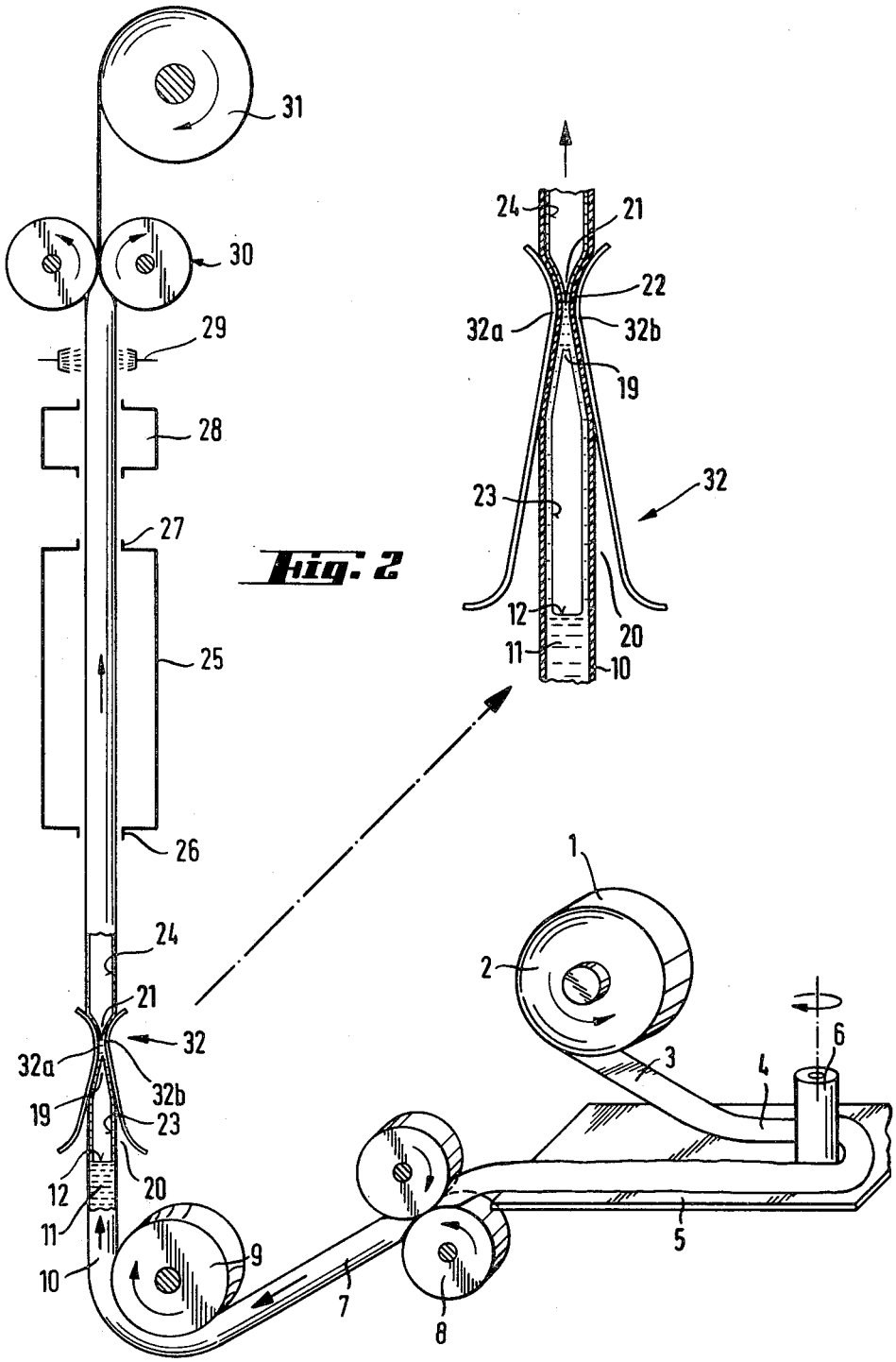
FIG. 2 illustrates an alternative embodiment of the present invention.

In FIG. 2 of the drawing, the numerals 1 to 12 and 22 to 31 have the same meaning as in FIG. 1. A pair of guide elements or shaping elements 32, comprising shaping elements **32*a* and 32*b*, delimit a cavity 19 having an entrance 20 and an exit 21** which forms a metering nip.

Figure 3:
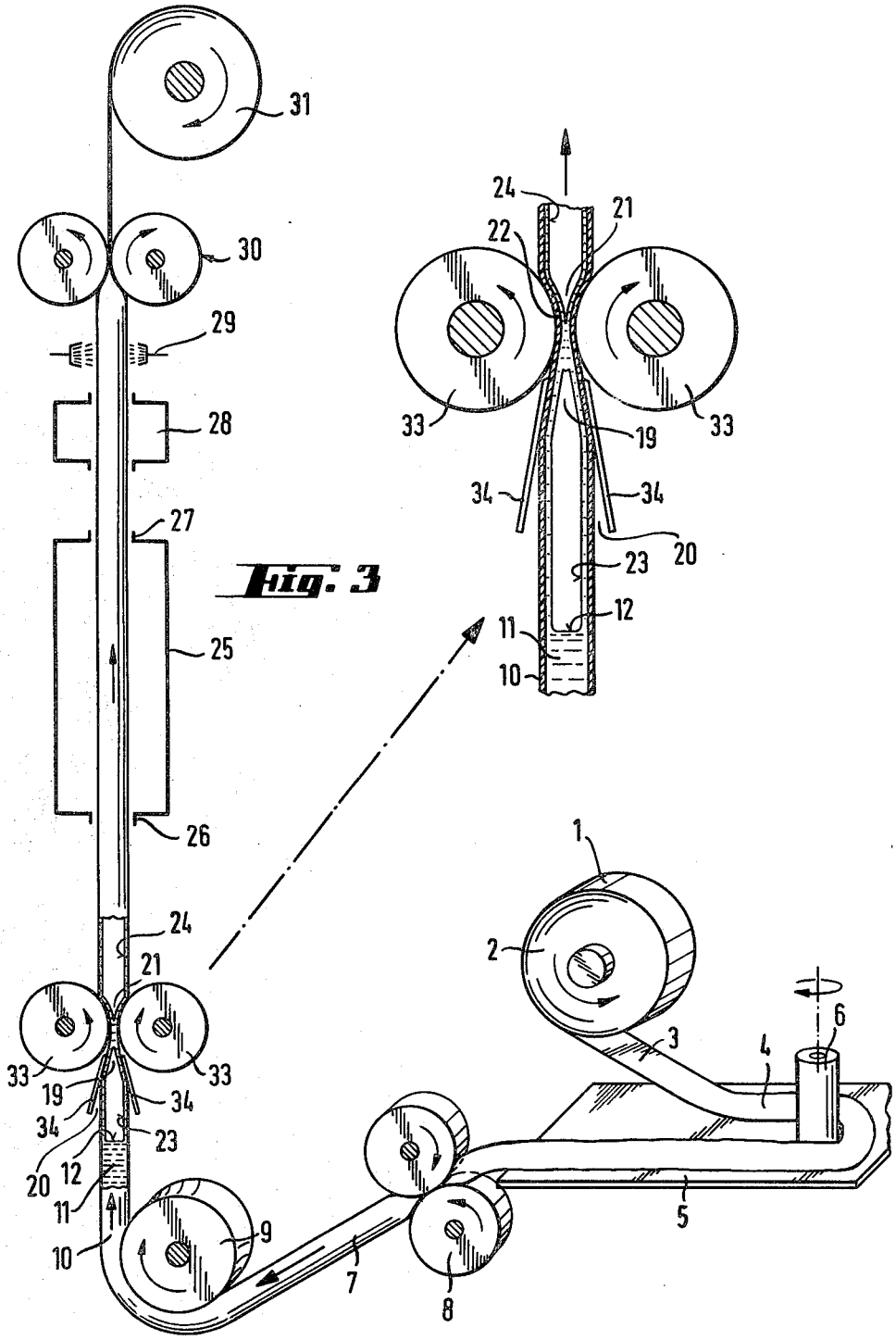
FIG. 3 illustrates yet another embodiment of the present invention.

In FIG. 3, the nip space 19 is formed by two guide panels 34 and two smooth metering rolls 33. The guide panels 34 constitute the nip space entry and cause the tubing to adopt a wedge-like shape in the direction of the metering nip 21 formed by the metering rolls 33.

The other reference numerals in FIG. 3 have the same meaning as in FIGS. 1 and 2.

In order to simplify the drawings, the motors for driving the different rolls and the elements for holding the individual parts of the apparatus in a fixed position are not shown in the drawings.

While the invention has been particularly shown and described with reference to preferred embodiments thereof, it is understood by those skilled in the art that various changes in form and detail may be made therein without departing from the spirit and scope of the invention as defined by the appended claims.

What is claimed is:

1. A process for coating the inside surface of a length of tubing esentially consisting of cellulose hydrate, comprising the steps of:

forming at least one loop of tubing having a cavity therein with a downwardly inclined portion and an upwardly inclined portion;

filling the cavity of the tubing forming the loop with a coating liquid;

transporting the tubing along its longitudinal axis in a substantially vertically upward direction to coat the inside of the tubing above the level of the coating liquid with an initial layer of coating liquid;

constricting the tubing adjacent to and above the level of the coating liquid along a constriction zone transverse to the longitudinal axis of the tubing, the constriction zone progressively diminishing in width in the direction of travel of the tubing to reduce the thickness of the initial layer and form a thin layer of desired thickness of the inside of the tubing issuing from the constriction zone;

filling the cavity of the tubing immediately upon issuance from the constriction zone with support gas in order to at least partially inflate the tubing; and exposing the tubing to heat at a sufficient temperature to remove the coating liquid and to fuse the coating layer to the inside of the tubing and form an uninterrupted film of uniform thickness thereon.

2. A process as recited in claim 1, further comprising the step of cooling the tubing after heating.

3. A process as recited in claim 1, further comprising the step of moistening the tubing after heating.

4. A process as recited in claim 1, wherein the coating liquid comprises and aqueous polymeric dispersion containing at least about 15% by weight of dispersed polymer based on the total weight of the dispersion.

5. A process as recited in claim 1, wherein the constriction step comprises passing the tubing between a pair of rotatably driven endless belts positioned on either side of the tubing and having substantially straight, adjacent and mutually facing parts which progressively converge towards one another to form the constriction zone.

6. A process as recited in claim 1, wherein the constriction step comprises passing the tubing between a pair of stationary guide elements positioned on either side of the tubing and having substantially straight, adjacent and mutually facing surfaces which progressively converge towards one another to form the constriction zone.

7. A process as recited in claim 6, wherein the guide elements have the form of doctor blades.

8. A process as recited in claim 1, wherein the constriction step comprises passing the tubing through a pair of spaced rolls positioned on either side of the tubing, having substantially straight, adjacent and mutually facing surfaces and forming the constriction zone.

9. A process as recited in claim 6 or 8, wherein the constriction step gradually flattens the tubing preventing the formation of folds in front of the constriction zone and forming a lay flat tubing, wherein the lay flat tubing is passed through the constriction zone.

10. A process as recited in claim 1, further comprising the step of preventing the coating liquid present in the tubing loop from flowing in a direction counter to the direction of travel of the tubing.

11. A process as recited in claim 10, wherein the step of preventing backward flow comprises flattening a part of the tubing loop.

12. A process as recited in claim 11, wherein the step of preventing backward flow further comprises conveying the coating liquid upstream from the flattened tubing in the direction of travel of the tubing.

13. A process as recited in claim 1, wherein the coating liquid comprises an aqueous polymeric dispersion containing from about 15 to 60% by weight of dispersed polymer relative to the total weight of the dispersion.

14. A process as recited in claim 1, 5, 6, 7 or 8, wherein said step of constricting comprises passing the tubing through a constriction zone of sufficient width to ensure an uninterrupted film corresponding to a weight per unit area of about 8 to 20 g of polymer per $m^2$ of tubing surface.

15. An apparatus for coating the inside surface of a length of tubing comprising:

means for forming at least one loop of tubing having a cavity therein with a downwardly inclined portion and an upwardly inclined portion;

means for transporting the tubing filled in the cavity of the loop with a coating liquid, along its longitudinal axis in a vertically upward direction;

a metering device having a constriction zone transverse to the longitudinal axis of the tubing which progressively diminishes in width in the direction of travel of the tubing;

means for filling the cavity of the tubing immediately upon issuance from the constriction zone with support gas in order to at least partially inflate the tubing; and a heater to heat the tubing after it leaves the metering device.

16. An apparatus as recited in claim 15, further comprising means for cooling the tubing positioned upstream from said heater.

17. An apparatus as recited in claim 16, further comprising means for moistening the tubing positioned upstream from said heater.

18. An apparatus as recited in claim 15, wherein said metering device comprises a pair of driven belts positioned on either side of the tubing and having substantially straight, adjacent and mutually facing parts which progressively converge towards one another.

19. An apparatus as recited in claim 15, wherein said metering device comprises a pair of stationary guide elements positioned on either side of the tubing and having substantially straight, mutually facing and adjacent surfaces which progressively converge towards one another.

20. An apparatus as recited in claim 15, further comprising means for preventing the coating liquid present in the tubing loop from flowing in a direction counter to the direction of travel of the tubing.

21. An apparatus as recited in claim 20, wherein said preventing means comprises means for flattening a part of the tubing loop.

22. An apparatus as recited in claim 21, wherein said flattening means partially flattens the tubing and conveys coating liquid upstream from the flattened tubing in the direction of travel of the tubing.

23. An apparatus as recited in claim 15, further comprising means for flattening the tubing after heating.

24. An apparatus as recited in claim 15, wherein said metering device comprises a substantially horizontal pair of rotatable spaced rolls positioned on either side of the tubing, having axes of rotation which are parallel and substantially transverse to the longitudinal axis of the tubing and substantially straight, adjacent and mutually facing surfaces.

25. An apparatus as recited in claim 19, wherein said guide elements have the form of doctor blades.

26. An apparatus as recited in claim 24 or 25, wherein guide or conveyor elements are positioned in front of said metering device on either side of the tubing, said elements comprising plates or rolls which progressively converge towards one another in the direction of said metering device for passing the tubing in a crease-free manner through said metering device.

* * * * *